United States Patent [19]

Machida et al.

[11] Patent Number: 4,973,540

[45] Date of Patent: Nov. 27, 1990

[54] DEVELOPER FOR ELECTROSTATIC LATENT IMAGE CONTAINING FINE PARTICLE COMPRISING POSITIVELY AND NEGATIVELY CHARGEABLE POLAR GROUP

[75] Inventors: Junji Machida; Masashi Yamamoto; Ichiro Demizu; Kouichi Etou, all of Osaka, Japan

[73] Assignee: Minolta Camera Kabushiki Kaisha, Osaka, Japan

[21] Appl. No.: 401,428

[22] Filed: Aug. 31, 1989

[30] Foreign Application Priority Data

| | | | |
|---|---|---|---|
| Aug. 31, 1988 | [JP] | Japan | 63-219538 |
| Aug. 31, 1988 | [JP] | Japan | 63-219539 |
| Aug. 31, 1988 | [JP] | Japan | 63-219540 |

[51] Int. Cl.[5] ..... G03G 9/00

[52] U.S. Cl. ..... 430/110; 430/111

[58] Field of Search ..... 430/110

[56] References Cited

U.S. PATENT DOCUMENTS

| | | | |
|---|---|---|---|
| 4,702,996 | 10/1987 | Imai et al. | 430/110 |
| 4,828,954 | 5/1989 | Hashimoto et al. | 430/110 |

FOREIGN PATENT DOCUMENTS

| | | | |
|---|---|---|---|
| 52-30437 | 3/1977 | Japan | 430/110 |
| 52-135739 | 11/1977 | Japan | 430/110 |
| 55-135854 | 10/1980 | Japan | 430/110 |
| 55-135855 | 10/1980 | Japan | 430/110 |
| 58-216252 | 12/1983 | Japan | 430/110 |
| 60-93455 | 5/1985 | Japan . | |

*Primary Examiner*—Marion C. McCamish
*Assistant Examiner*—S. Crossan
*Attorney, Agent, or Firm*—Burns, Doane, Swecker & Mathis

[57] ABSTRACT

This invention relates to a developer for developing electrostatic latent images formed on an electrostatic latent image carrier, which comprises a toner including;

a resin, a colorant, and an inorganic fine particle with at least both a negatively chargeable polar group and a positively chargeable polar group on the surface of the inorganic fine particle.

23 Claims, 4 Drawing Sheets

DEVELOPER FOR ELECTROSTATIC LATENT IMAGE CONTAINING FINE PARTICLE COMPRISING POSITIVELY AND NEGATIVELY CHARGEABLE POLAR GROUP

BACKGROUND OF THE INVENTION

This invention relates to a developer for developing electrostatic latent images in electrophotography, electrostatic recording, electrostatic printing and the like.

In electrophotography etc., electrostatic latent images are developed normally or reversely to make them visible by a cascade developing method (U.S. Pat. Nos. 2,297,691, 2,618,552), a magnetic blush developing method (U.S. Pat. No. 2,832,311), (both methods use a developer of mixture of a toner with a carrier), or by a touch down developing method (U.S. Pat. No. 4,121,931) wherein a developer is composed only of a toner, or by a nonmagnetic single component developing method (U.S. Pat. No. 3,731,146), and thereby stable copied images of high quality are obtained.

In general, a toner suitable for developing methods aforementioned is the one that is prepared by mixing a thermoplastic resin as a binder resin with a colorant such as a dye or a pigment, a positive or negative charge-controlling agent or a surface lubricant such as a wax, followed by kneading, grounding and classifying to obtain toner particles of 5–20 μm in mean particle size.

A charge controlling agent that charges a toner positively is disclosed, for example, in U.S. Pat. Nos. 4,338,390, 4,490,455, 4,493,883, or 4,415,646.

A charge controlling agent that charges a toner negatively is disclosed, for example, in U.S. Pat. Nos. 4,206,064, 4,656,112, 4,665,001.

However, when these toners per se known are used singly, there are such problems as unstability of chargeability of toners, electrification-build-up properties and uniformity of charged amount because of poor dispersion of charge controlling agents in toners.

It is known that chargeability of toner is controlled by using a resin having a polar group suitable for positive charging, for example, in U.S. Pat. Nos. 4,371,601, 4,504,563 or 4,686,166. These resins per se known, however, have amino groups, and so there are such problems as charging stability and electrification-build-up properties under highly humid environment.

On the other hand, it is known that a resin having a polar group suitable for negative charging is used for controlling chargeability of toner, for example, in U.S. Pat. No. 3,998,747. These resins per se known, however, show such problems as charging stability and electrification-build-up properties in spite of the presence of a halogen group, or oxygen group.

It is known that inorganic fine particles are used as charge giving materials. Japanese Patent Laid Open Nos. 135739/1977, 123550/1981 disclose that metal oxide powders treated with amino-silane can give strong positive chargeability. But, because aminosilane is hydrophilic, there arise such problems as toner flow characteristics and charge variation with time under high temperature and high humidity. There is also known a toner containing metal oxide treated with aminosilane and a hydrophobic agent in Japanese Patent Laid-Open Nos. 216252/1983, 73271/1988, 73272/1988. There also arise such problems as toner flow characteristics, electrification-build-up properties and charging stability.

It is known that controlling agents for positive charging are absorbed on hydrophobic silica fine particles in, for example, Japanese Patent Laid-Open Nos. 135855/1980, 80651/1983. There also arise such problems as toner flow characteristics, electrification-build-up properties and charging stability.

Japanese Patent Publication No. 20344/1979 discloses a negatively chargeable toner containing hydrophobic silica fine particles. Hydroxy groups on the surface of silica particles are, for example, replaced by hydrophobic groups such as a methyl group and the like. Such silica as thus prepared can be charged negatively, but there also arises such a problem as unsatisfactory electrificaition-build-up properties etc.

Japanese Patent Publication No. 93455/1985 is to improve a negative charging level of a toner by utilizing charging properties of polar groups present on the surface of inorganic fine particles, which are surface-treated with fluorine-substituted silane coupling agent having polar groups suitable for negative charging. It is sure that such a toner has been improved in charging level, but flow characteristics of a toner, electrification-build-up properties and charging stability are insufficient.

Conventional toners can not solve such problems as flow characteristics of toner, dirts of copied images caused by toner flying, dirts inside a machine, fogs on a copying ground, fogs like memorized images and voids in copied images or the like in a high-speed copying machine desired recently, a color-copying machine, an electrophotographic printer or a non-magnetic single component developing machine.

Further, Japanese Patent Laid-Open No. 135854/1980 discloses that controlling agents for negative charging are absorbed on silica fine particles. But, there are such problems as toner flow characteristics, electrification-build-up properties and charging stability.

SUMMARY OF THE INVENTION

The object of the invention is to provide a developer excellent in flow characteristics, electrification-build-up properties, stability and uniformity of charge amount, charging level, and the like.

The present invention relates to a developer for developing electrostatic latent images formed on an electrostatic latent image carrier, which comprises a toner comprising at least a resin, a colorant, an inorganic fine particle comprising at least both a negatively chargeable polar group and a positively chargeable polar group on the surface of the inorganic fine particle.

DETAILED DESCRIPTION OF THE INVENTION

Figure 1:
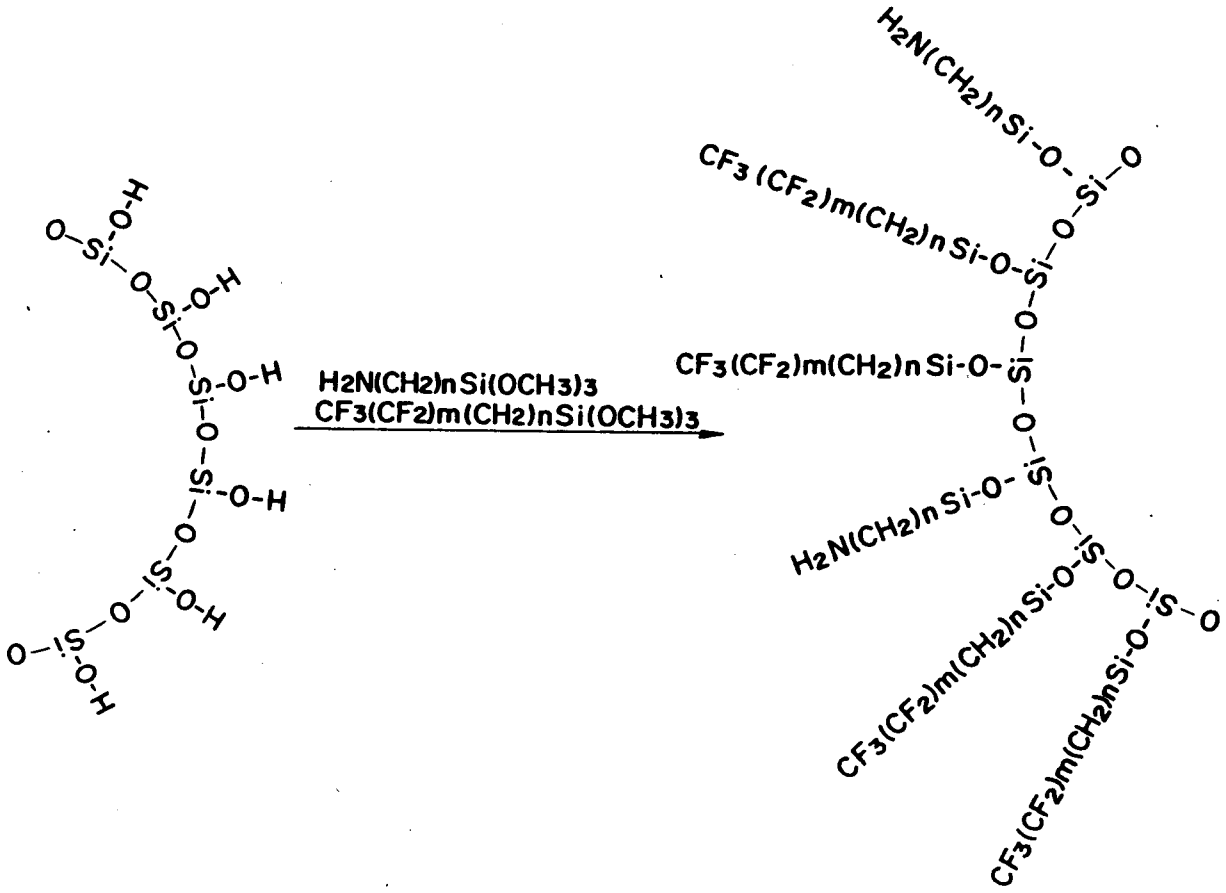
FIG. 1 shows that the surface of silica particles are treated by coupling hydroxy groups on the surface of silica particle with coupling agents.

The present invention provides a developer excellent in flow characteristics, electrification-build-up properties, stability and uniformity of charge amount, charging level and the like.

The present invention has accomplished the above object by incorporating inorganic fine particles which are treated with both a coupler having a negatively chargeable polar group and a coupler having a positively chargeable polar group.

A developer of the present invention comprises an inorganic fine particle comprising at least both a negatively chargeable polar group and a positively chargeable polar group on the surface of inorganic fine particle.

An inorganic fine particle includes silicon dioxide (anhydride), which may be prepared by wet process or dry process, silicates such as aluminium silicate, magnesium silicate and the like, titanium dioxide, alumina, magnesium carbonate, barium titanate, zinc oxide, a mixture thereof, and the like, being 1 mμm–2 μm, preferably 5 mμm–1 μm in mean particle size.

These inorganic particles are desirably heat-treated at 100° C. or more before they are treated for coupling treatment.

An inorganic particle is treated by both a coupler having a negatively chargeable polar group and a coupler having a positively chargeable polar group, resulting in bonding of these polar groups onto the surface of the inorganic particle.

A coupling agent having a negatively chargeable polar group is exemplified by silane fluorine coupling agents such as $CF_3(CH_2)_2SiCl_3$ $CF_3(CF_2)_5SiCl_3$ $CF_3(CF_2)_5(CH_2)_2SiCl_3$ $CF_3(CF_2)_7(CH_2)_2SiCl_3$ $CF_3(CF_2)_7CH_2CH_2Si(OCH_3)_3$ $CF_3(CF_2)_7(CH_2)_2Si(CH_3)Cl_3$ $CF_3(CH_2)_2Si(OCH_3)_3$ $CF_3(CH_2)_2Si((CH_3)(OCH_3)_2$ $CF_3(CF_2)_3(CH_2)_2Si(OCH_3)_3$ $CF_3(CF_2)_5(CH_2)_2Si(OCH_3)_3$ $CF_3(CF_2)_6CONH(CH_2)_2Si(OC_2H_5)_3$ $CF_3(CF_2)_6COO(CH_2)_2Si(OCH_3)_3$ $CF_3(CF_2)_7(CH_2)_2Si(OCH_3)_3$ $CF_3(CF_2)_7(CH_2)_2Si(CH_3)(OCH_3)_2$ $CF_3(CF_2)_7SO_2NH(CH_2)_3Si(OC_2H_5)_3$ $CF_3(CF_2)_8(CH_2)_2Si(OCH_3)_3$ a mixture thereof and the like.

A coupling agent having a positively chargeable polar group is exemplified by amine coupling agent such as $H_2N(CH_2)_2NH(CH_2)_3Si(OCH_3)_3$ $H_2N(CH_2)_2NH(CH_2)_3Si(CH_3)(OCH_3)_2$ $H_2N(CH_2)_2NH(CH_3)_3Si(OCH_3)_3$ $H_2N(CH_2)_2NH(CH_2)_2NH(CH_2)_3Si(OCH_3)_3$ $H_2N(CH_2)_3Si(OCH_3)_3$ $C_6H_5NH(CH_2)_3Si(OCH_3)_3$

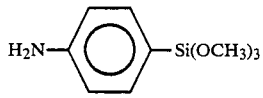

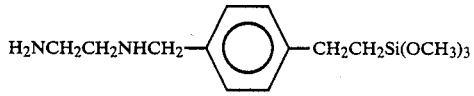

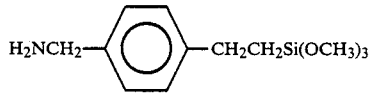

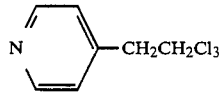

a mixture thereof and the like.

An inorganic particle may be further treated by hydrophobic agents as well as coupling agents having a positively chargeable polar group and a negatively chargeable polar group, to restrain effectively changes of characteristics influenced by environments, in particular, by humidity.

A hydrophobic agent is exemplified by silanes, titanates, aluminium series, zircoaluminates and the like. Silanes include chlorosilane, alkylsilane, alkoxysilane, silazane and the like. In more detail, $CH_3SiCl_3$ $(CH_3)_2SiCl_2$ $(CH_3)_3SiCl$ $CH_3Si(OCH_3)_3$ $CH_3Si(OCH_2CH_3)_3$ $(CH_3)_3Si(OCH_3)$ $(CH_3)_2Si(OCH_3)_2$ $(CH_3)_2Si(OCH_2CH_3)_2$ $Si(OCH_2CH_3)_4$ $Si(OCH_3)_4$ $CH_3(H)Si(OCH_3)_2$
$CH_3(H)Si(OCH_2CH_3)_2$
$(CH_3)_2(H)Si(OCH_2CH_3$
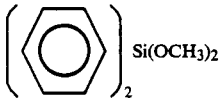
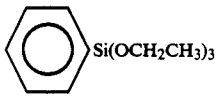
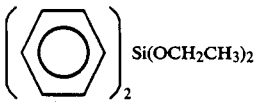
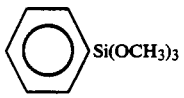
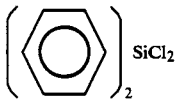
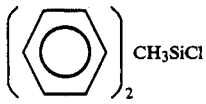
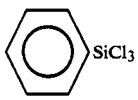
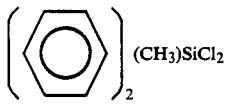
$(CH_3)_3SiNHSi(CH_3)_3$
$CH_3(CH_2)_{17}Si(CH_3)(OCH_3)_2$
$CH_3(CH_2)_{17}Si(OCH_3)_3$
$CH_3(CH_2)_{17}Si(OCH_2H_5)_3$
$CH_3(CH_2)_3Si(CH_3)_2Cl$
$CH_3(CH_2)_{17}Si(CH_3)_2Cl$
$CH_3(CH_2)_{17}Si(CH_3)Cl_2$
$CH_3(CH_2)_{17}SiCl_3$
are exemplified.
Titanates are exemplified by
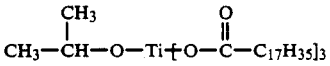
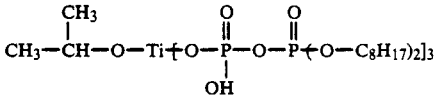
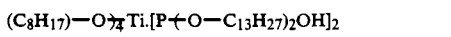
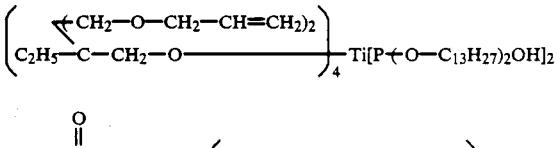
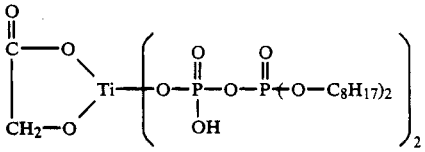
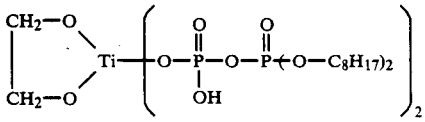
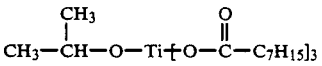
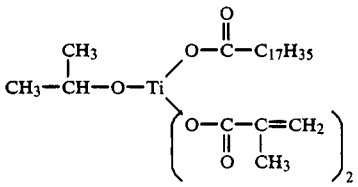
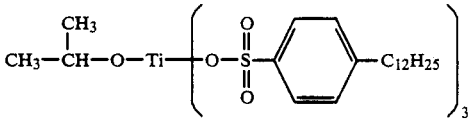
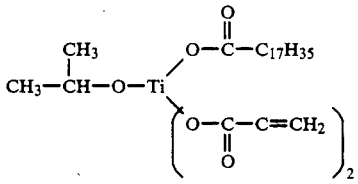
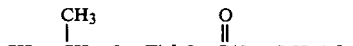
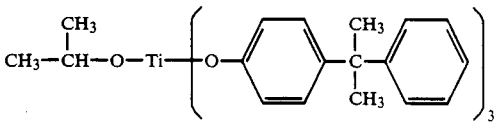
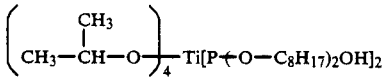

An inorganic fine particle is treated so that hydrophobic degree may be 30–80%. The hydrophobic degree (%) is obtained as below;

For example, 0.2 g of silica is added to 50 ml of pure water into a beaker with a capacity of 200 ml. Methanol dehydrated with sodium sulfate anhydride is added through a buret under stirring conditions, and then the added amount of methanol (c) is read when silica particles are almost not recognized on the liquid level. The hydrophobic degree is calculated from the formula below;

$$\text{Hydrophobic degree (\%)} = \frac{C}{50 + C} \times 100$$

wherein C is an added amount of methanol

An inorganic particle is surface-treated with the coupling agents as follows;

First, a coupling agent is mixed for dilution with a solvent such as tetrahydrofuran (THF), toluene, ethyl acetate, methyl ethyl ketone, acetone and the like. The obtained dilute solution is added to inorganic particles by dropping or spraying under forcible stirring conditions by, for example, a blender. After sufficient mixing, the obtained mixture is heated and dried on a bat etc. in an oven. After drying, the inorganic particles are stirred and sufficiently ground by a blender. In the process above, two kinds of a coupling agent, i.e. the one having a negatively chargeable group and the other having a positively chargeable group, may be used at the same time or at the different time.

Another treatment method called a wet method to the dry method above mentioned may be used. Namely, after inorganic particles are dipped in an solution containing a coupling agent in an organic solvent, the solvent is removed to obtain dried inorganic particles. An aqueous solution containing a coupling agent may be added to a slurry of inorganic particles dispersed in water, and then the inorganic particles are allowed to be settled followed by heat-drying.

In a dry or wet treatment process, when silicon dioxide is used as an inorganic particle and surface-treated by fluorine-coupling agents and amino-coupling agents, hydroxy groups on the surface of silicon dioxide particle are reacted with silane compounds reversibly, resulting in the introduction of both fluorine-containing groups and nitrogen-containing groups onto the surface of the inorganic fine particle, as shown in FIG. 1.

An inorganic particle is coupling treated such that fluorine atom in the coupling treated inorganic particle is contained at the content of 0.005%–6% and that nitrogen atom is contained at the content of 0.04%–5% for improving flow characteristics.

When an inorganic particle is treated to the direction of negative chargeability, the usage of a coupling agent having a positively chargeable group and a coupling agent having a negatively chargeable group, is adjusted such that the fluorine atom content is higher than the nitrogen atom content. In particular, an inorganic particle is treated such that the content of fluorine atom in the coupling-treated inorganic fine particle is 2.0%–6.0% and that the content of nitrogen atom is 0.04–0.2%, preferably the content of fluorine atom is 2.5–4% and that the content of nitrogen atom is 0.05–0.2%. The inorganic particle as treated above shows −800–−500 μC/g in chargeability by a blow-off charge measurement method. When such an inorganic particle is applied to a toner, the charging level of the toner and the electrification build-up properties become excellent.

When an inorganic particle is used in a positively chargeable toner, the inorganic particle is treated such that the content of fluorine atom in the coupling-treated inorganic fine particle is 0.005%–0.2% and that the content of nitrogen atom is 2.00–5%, preferably, the content of fluorine atom is 0.02–0.15% and that the content of nitrogen atom is 2.1–3%. The inorganic particle as treated above shows +500–+800 μC/g in chargeability by a blow-off charge measurement method. When such an inorganic particle is applied to a toner, the charging level of the toner and the electrification build-up properties become excellent.

Further, when an inorganic particle which is treated by a coupling agent having a negatively chargeable group and a coupling agent having a positively chargeable group such that it shows +500 μC/g–−500 μC/g in chargeability by a blow-off charge measurement method is also effective in the improvement of flow characteristics of a toner. In this case, an inorganic fine particle is coupling-treated so that the content of fluorine atom in the coupling-treated inorganic fine particle may be 0.1%–3% and that the content of nitrogen atom may be 0.04%–3%, and adjusted so that the charge amount as above mentioned may be obtained. The addition of such inorganic particle is particularly effective in the improvement of flow characteristics of a two-component developer containing a toner and a carrier.

The content of fluorine atom (F (%)) and the content of nitrogen atom (N (%)) may be measured by an analytic method below. The content of fluorine atom may be analyzed by an ion-chromatographic method. That is, a sample of about 10 mg is weighed accurately. The sample is burned and the generated gases are absorbed in 10 ml of distilled water. The resultant solution is diluted to be half in concentration. And then, the diluted solution is subjected to ion-chromatograph to determine the content of fluorine atom in comparison with the pre-prepared calibration curve of fluorine atom. The thus obtained value of the content of fluorine atom is used in the present invention.

The value of the content of nitrogen atom in the present invention means the value measured by C,H,N-coder MT-3 type (made by Yanagimoto Seisakusho K.K.) using a sample of about 2–3 mg.

When a relatively large amount of a coupling agent having a positively chargeable group is used, an inorganic particle is preferably treated with a hydrophobic agent, because the particle becomes poor in water-resistance being caused by hydrophilic groups such as amino groups and the like.

When a surface-treated inorganic fine particle is adhered uniformly on the surface of the toner, the particle may be merely stirred and mixed with the toner by a known method, for example, a blender or a mixer.

When an inorganic particle is incorporated into a toner the inorganic particle may be added at the same time of kneading of the toner to disperse the inorganic particle in the toner uniformly (called "inner addition"). When a toner is prepared by a polymerization method, an inorganic particle is added at the polymerization time so that the inorganic particle may be incorporated at the same time in the formation of toner. An inorganic particle may be also fixed on the surface of a toner by mechanical shearing force generated by hybridization system, mechnofusion system or the like.

In general, a toner is a fine particle composed of at least a binder resin, a colorant. There is known a various types of toners, such as a toner used in two components in combination of a carrier, a toner containing a magnetic material therein (a magnetic toner) used singly, a toner containing no magnetic material (a non-magnetic toner) used singly or the like. An inorganic particle coupling-treated according to the present invention may be applied to any type of toners.

An inorganic particle may be added to a toner at an usual amount depending on whether the toner is used in a single component system (magnetic or non-magnetic) or in a two components system, or whether the inorganic particle merely is mixed with the toner, incorporated into the toner or fixed on the surface of toner.

For example, when a toner is used in two components system, an surface-treated inorganic particle is mixed at the content of 0.05–5% by weight, preferably 0.1–2% by weight on the basis of the toner.

A non-magnetic toner, which is generally composed of at least a binder resin, and a colorant, is mixed with an surface-treated inorganic particle at the content of 0.1–3% by weight, preferably 0.5–2% by weight on the basis of toner.

With respect to a binder resin used for formation of a toner, various types of resins are known, for example, acrylic resin, polystyrene resin, polyester resin, styrene-acrylic copolymer resin, epoxy resin and the like.

When a toner is used in a non-magnetic single component developing machine, a preferable resin is polyester, a particularly preferable resin is bisphenol A-type polyester resin. In a non-magnetic single component developing machine, a toner is charged with a regulatory member pressed against a developing member and then a thin layer of toner is formed. If a toner is composed of acrylic resin, styrene-acrylic copolymer or the like, a toner is given a stress to fix and/or weld to the regulatory member or the developing sleeve. Therefore, the uniform formation of a thin layer of toner is prevented, and a deterioration of copied images is caused by absence of toner particles like a white line in the thin layer of toner or an insufficient charge amount of toner.

However, when a toner is composed of a polyester resin, it does not fix or weld to a sleeve member or a regulatory member. Further, in particular, bisphenol A-type polyester resin is negatively chargeable, and has various balanced properties required for a negatively chargeable toner such as excellent resistance to off-set at heat-fixing with a roller, good affinity with copying paper, good resistance to heat, no migration to plasticizer.

When a toner is fixed with a heat-roller, a release agent such as wax etc. is generally added to the toner in order to prevent the toner from fixing to the heat roller. A wax is, in general, exemplified by polyolefin such as polypropylene of low molecular weight or polyethylene of low molecular weight. When polyester resin is used as a binder resin, polyolefin of oxidized type which has a polar group is preferable because of good compatibility with the resin. A non-polar wax is poor in compatibility with polyester resin. Even if a non-polar wax is incorporated into a toner, it is liable to leave from the toner. Therefore, a filming phenomenon of toner is observed on a photosensitive drum or a toner fixes or weld to a developing roller. The use of poly-olefin of oxidized type does not cause the problems above mentioned because of its good compatibility with polyester.

This invention is explained by first the preparations of Fine Particles (a)–(r) and second the Examples 1–22 and Comparative Examples 1–18, In examples 1–8 and Comparative Examples 1–6, Fine Particles are admixed externally with toner particles.

In examples 9–15 and Comparative Examples 7–12, Fine Particles are incorporated into toner particles or fixed on the surface of toner particles.

In Examples 16–22 and Comparative Examples 13–18, Fine Particles are applied to a non-magnetic toner of single component.

Preparation of Fine Particle (a)

3.3, 4.4, 5.5, 6.6, 7.7, 8.8, 9.9, 10.10.10-heptadecafluorodecyl trimethoxy silane of 1.5 g as a fluorine containing coupling agent, γ-aminopropyl triethoxy silane of 0.15 g as a nitrogen containing coupling agent and hexamethyl disilazane of 0.5 g were dissolved in tetrahydrofuran of 10 g to prepare a mixed solution.

AEROSIL 300 (made by Nippon Aerosil K.K.), which is colloidal silica used as an inorganic particle, was treated in a dryer at 120° C. for 2 hours. Thus treated AEROSIL of 25 g was taken into a high-speed mixer, to which the above prepared mixed solution was slowly added for 5 minutes under stirring condition.

The resultant mixed-solution was further stirred sufficiently for 10 minutes in a constant temperature bath. The obtained lump was ground to obtain hydrophobic Fine particle (a), which had hydrophobic degree of 58%, analytical value of F=3.142%, and N=0.0609%.

Preparation of Fine Particle (b)

3.3, 4.4, 5.5, 6.6, 7.7, 8.8.8-tridecafluorooctyl trimethoxy silane of 2 g as a fluorine-containing coupling agent, N-(β-aminoethyl)γ-aminopropyl trimethoxy silane of 0.3 g as a nitrogen-containing coupling agent and dimethyl dichlorosilane of 3 g were dissolved in acetone of 12 g to prepare a mixed solution.

Fine particle (b) was prepared using 35 g of colloidal silica as an inorganic fine particle (AEROSIL 200; made by Nippon Aerosil K.K.) in a manner similar to the preparation of Fine particle (a). The Fine particle (b) had hydrophobic degree of 67%, analytical value of F=2.620% and N=0.163%.

Preparation of Fine Particle (c)

3.3, 4.4, 5.5, 6.6, 7.7, 8.8.8-tridecafluorooctyl trimethoxy silane of 0.5 g as a fluorine-containing coupling agent, γ-aminopropyl triethoxy silane of 2 g as a nitrogen-containing coupling agent and dimethyl dimethoxy silane of 3 g were dissolved in tetrahydrofuran of 10 g to prepare a mixed solution.

Fine particle (c) was prepared using 30 g of colloidal silica as an inorganic fine particle (AEROSIL 130; made by Nippon Aerosil K.K.) in a manner similar to the preparation of Fine particle (a). The Fine particle (c) had hydrophobic degree of 40%, analytical value of F=0.744% and N=0.621 %.

Preparation of Fine Particle (d)

3.3, 4.4, 5.5, 6.6, 7.7, 8.8, 9.9, 10.10.10-heptadecafluorodecyl trimethoxy silane of 1.5 g as a fluorine-containing coupling agent, γ-aminopropyl triethoxy silane of 0.05 g as a nitrogen-containing coupling agent and trimethyl chlorosilane of 2 g were dissolved in methyl ethyl ketone of 10 g to prepare a mixed solution.

Fine particle (d) was prepared using 13 g of colloidal silica as an inorganic fine particle (AEROSIL 130; made by Nippon Aerosil K.K.) in a manner similar to the preparation of Fine particle (a). The Fine particle (d) had hydrophobic degree of 57%, analytical value of F=5.154% and N=0.0336%.

Preparation of Fine Particle (e)

3.3, 4.4, 5.5, 6.6, 7.7, 8.8.8-tridecafluorooctyl trimethoxy silane of 0.5 g as a fluorine-containing coupling agent, N-(β-aminoethyl)γ-aminopropyl trimethoxy silane of 6 g as a nitrogen-containing coupling agent and hexamethyl disilazane of 3 g were dissolved in tetrahydrofuran of 10 g to prepare a mixed solution.

Fine particle (e) was prepared using 40 g of colloidal silica as an inorganic fine particle (AEROSIL 130; made by Nippon Aerosil K.K.) in a manner similar to the preparation of Fine particle (a). The Fine particle (e) had hydrophobic degree of 65%, analytical value of F=0.533% and N=2.660%.

Preparation of Fine Particle (f)

3.3.3-trifluoropropyl trimethoxy silane of 0.1 g as a fluorine-containing coupling agent, N-(β-aminoethyl)γ-aminopropyl trimethoxy silane of 2.5 g as a nitrogen-containing coupling agent and hexamethyl disilazane of 2.5 g were dissolved in tetrahydrofuran of 12 g to prepare a mixed solution.

Fine particle (f) was prepared using 20 g of colloidal silica as an inorganic fine particle (AEROSIL 200; made by Nippon Aerosil K.K.) in a manner similar to the preparation of Fine particle (a). The Fine particle (f) had hydrophobic degree of 60%, analytical value of F=0.104% and N=2.185%.

Preparation of Fine Particle (g)

3.3.3-trifluoropropyl trimethoxy silane of 0.1 g as a fluorine-containing coupling agent, N-(β-aminoethyl)γ-aminopropyl trimethoxy silane of 7 g as a nitrogen-containing coupling agent and hexamethyl disilazane of 2 g were dissolved in tetrahydrofuran of 10 g to prepare a mixed solution.

Fine particle (g) was prepared using 60 g of colloidal silica as an inorganic fine particle (AEROSIL 300; made by Nippon Aerosil K.K.) in a manner similar to the preparation of Fine particle (a). The Fine particle (g) had hydrophobic degree of 53%, analytical value of F=0.044% and N=2.599%.

Preparation of Fine Particle (h)

3.3.3-trifluoropropyl trimethoxy silane of 0.02 g as a fluorine-containing coupling agent, N-(β-aminoethyl)γ-aminopropyl trimethoxy silane of 10 g as a nitrogen-containing coupling agent and hexamethyl disilazane of 2 g were dissolved in methyl ethyl ketone of 10 g to prepare a mixed solution.

Fine particle (h) was prepared using 60 g of colloidal silica as an inorganic fine particle (AEROSIL 130; made by Nippon Aerosil K.K.) in a manner similar to the preparation of Fine particle (a). The Fine particle (h) had hydrophobic degree of 59%, analytical value of F=0.0072% and N=3.048%.

Preparation of Fine Particle (i)

3.3, 4.4, 5.5, 6.6, 7.7, 8.8, 9.9, 10.10.10-heptadecafluorodecyl trimethyoxy silane of 4 g as a fluorine-containing coupling agent, γ-aminopropyl triethoxy silane of 0.1 g as a nitrogen-containing coupling agent were dissolved in methyl ethyl ketone of 10 g to prepare a mixed solution.

Fine particle (i) was prepared using 30 g of colloidal silica as an inorganic fine particle (AEROSIL 300; made by Nippon Aerosil K.K.) in a manner similar to the preparation of fine particle (a). The fine particle (i) had hydrophobic degree of 61%, analytical value of F=6.302% and N=0.030%.

Preparation of Fine Particle (j)

3.3.3-trifluoropropyl trimethoxy silane of 0.01 g as a fluorine-containing coupling agent, N-(β-aminoethyl)γ-aminopropyl trimethoxy silane of 7 g as a nitrogen-containing coupling agent and hexamethyl disilazone of 2 g were dissolved in methyl ethyl ketone of 10 g to prepare a mixed solution.

Fine particle (j) was prepared using 40 g of colloidal silica as an inorganic fine particle (AEROSIL 300; made by Nippon Aerosil K.K.) in a manner similar to the preparation of Fine particle (a). The Fine particle (j) had hydrophobic degree of 59%, analytical value of F=0.004% and N=2.523%.

Preparation of Fine Particle (k)

3.3, 4.4, 5.5, 6.6, 7.7, 8.8, 9.9, 10.10.10-heptadecafluorodecyl trimethoxy silane of 7 g was dissolved in acetone of 10 g to prepare a mixed solution.

Fine particle (k) was prepared using 40 g of colloidal silica as an inorganic fine particle (AEROSIL 130; made by Nippon Aerosil K.K.) in a manner similar to the preparation of Fine particle (a). The Fine particle (k) had hydrophobic degree of 40%, analytical value of F=9.235% and N=0%.

Preparation of Fine Particle (l)

N-(β-aminoethyl)γ-aminopropyl triethoxy silane of 4 g as a nitrogen-containing coupling agent and hexamethyl disilazone of 3 g were dissolved in tetrahydrofuran of 10 g to prepare a mixed solution.

Fine particle (l) was prepared using 20 g of colloidal silica as an inorganic fine particle (AEROSIL 200; made by Nippon Aerosil K.K.) in a manner similar to the preparation of Fine particle (a). Fine particle (l) had hydrophobic degree of 63%, analytical value of F=0% and N=2.436%.

Preparation of Fine Particle (m)

Dimethyl dichlorosilane of 6 g was dissolved in acetone of 10 g to prepare a mixed solution.

Fine particle (m) was prepared using 50 g of colloidal silica as an inorganic fine particle (AEROSIL 200; made by Nippon Aerosil K.K.) in a manner similar to the preparation of Fine particle (a). Fine particle (l) had hydrophobic degree of 37%, analytical value of F=0% and N=0%.

Preparation of Fine Particle (n)

Fine particle (n) was colloidal silica (AEROSIL 200; made by Nippon Aerosil K.K.) which was not treated. It had analytical value of F=0 and N=0%.

Preparation of Fine Particle (o)

Colloidal silica (35 g) (AEROSIL 130; made by Nippon Aerosil 130) was put into a whirling blender for stirring for about 3 minutes to grind the silica.

3.3, 4.4, 5.5, 6.6, 7.7, 8.8, 9.9, 10.10.10-heptadecafluorodecyl trimethoxy silane of 4 g as a fluorine-containing coupling agent, N-(β-aminoethyl)γ-aminopropyl triethoxy silane of 0.15 g as a amino group-containing coupling agent and dimethyl dimethoxy silane of 2 g were dissolved in tetrahydrofuran of 10 g to prepare a mixed solution.

The obtained mixed solution was dropped slowly into the silica through a buret under stirring condition. After dropping, the resultant solution was stirred strongly at higher revolution number for about 10 minutes. Then, the obtained mixture was moved onto a bat. The mixture on the bat was heated for drying at 120° C. in an oven for about 3 hours. After drying, the dried mixture was again ground to obtain hydrophobic Fine particle (o), which had hydrophobic degree of 60%, analytical value of F=5.52% and N=0.04%.

Preparation of Fine Particle (p)

3.3, 4.4, 5.5, 6.6, 7.7, 8.8.8-tri-decafluorooctyl trimethoxy silane of 1.4 g as a fluorine-containing coupling agent, aminopropyl triethoxy silane of 0.1 g as a nitrogen-containing coupling agent and hexamethyl disilazane of 0.5 g were dissolved in tetrahydrofuran of 10 g to prepare a mixed solution.

AEROSIL 300 (made by Nippon Aerosil K.K.), which is colloidal silica used as an inorganic particle, was treated in a dryer at 120° C. for 2 hours. Thus treated AEROSIL of 20 g was taken into a high-speed mixer, to which the above prepared mixed solution was slowly added for 5 minutes under stirring condition.

The resultant mixed-solution was further stirred sufficiently for 10 minutes, and then heated at 150° C. in a constant temperature bath. The obtained lump was ground to obtain hydrophobic Fine particle (p), which had hydrophobic degree of 52%, analytical value of F=3.36%, and N=0.05%.

Preparation of Fine Particle (q)

3.3, 4.4, 5.5, 6.6, 7.7, 8.8.8-tri-decafluorooctyl trimethoxy silane of 1.1 g as a fluorine-containing coupling agent, aminopropyl triethoxy silane of 0.4 g as a nitrogen-containing coupling agent and hexamethyl disilazane of 0.5 g were dissolved in acetone of 12 g to prepare a mixed solution.

Fine particle (q) was prepared using 20 g of colloidal silica as an inorganic fine particle (AEROSIL 200; made by Nippon Aerosil K K.) in a manner similar to the preparation of fine particle (o). The Fine particle (q) had hydrophobic degree of 52%, analytical value of F=2.65% and N=0.198%.

Preparation of Fine Particle (r)

3.3.3-trifluoropropyl trimethoxy silane of 0.04 g as a fluorine-containing coupling agent, N-(β-aminoethyl)γ-aminopropyl trimethoxy silane of 10 g as a nitrogen-containing coupling agent and hexamethyl disilazane of 2 g were dissolved in tetrahydrofuran of 12 g to prepare a mixed solution.

Fine particle (r) was prepared using 60 g of colloidal silica as an inorganic fine particle (AEROSIL 130; made by Nippon Aerosil K.K.) in a manner similar to the preparation of Fine particle (o). The Fine particle (r) had hydrophobic degree of 59%, analytical value of F=0.141% and N=3.045%.

The usage, hydrophobic degree and charge amount measured by a blow-off method of Fine particles (a)–(r) were summarized in Table 1.

The charge amount was measured by Toshiba Blow-Off Particle Charge Amount Measuring Apparatus (made by Toshiba K.K.).

TABLE 1

| fine particle | inorganic fine particle (g) | coupling agent: negatively chargeable (g) | coupling agent: positively chargeable (g) | coupling agent: hydrophobic (g) |
|---|---|---|---|---|
| a | Aerosil 300 (25) | $CF_3(CF_2)_7(CH_2)_2Si(OCH_3)_3$ (1.5) | $NH_2(CH_2)_3Si(OCH_2CH_3)_3$ (0.15) | $(CH_3)_3SiNHSi(CH_3)_3$ (0.5) |
| b | Aerosil 200 (35) | $CF_3(CF_2)_5(CH_2)_2Si(OCH_3)_3$ (2) | $NH_2(CH_2)_2NH(CH_2)_3Si(OCH_3)_3$ (0.3) | $(CH_3)_2SiCl_2$ (3) |
| c | Aerosil 130 (30) | $CF_3(CF_2)_5(CH_2)_2Si(OCH_3)_3$ (0.5) | $NH_2(CH_2)_3Si(OCH_2CH_3)_3$ (2) | $(CH_3)_2Si(OCH_3)_2$ (3) |
| d | Aerosil 130 (13) | $CF_3(CF_2)_7(CH_2)_2Si(OCH_3)_3$ (1.5) | $NH_2(CH_2)_3Si(OCH_2CH_3)_3$ (0.05) | $(CH_3)_3SiCl$ (2) |
| e | Aerosil 130 (40) | $CF_3(CF_2)_5(CH_2)_2Si(OCH_3)_3$ (0.5) | $NH_2(CH_2)_2NH(CH_2)_3Si(OCH_3)_3$ (6) | $(CH_3)_3SiNHSi(CH_3)_3$ (3) |
| f | Aerosil 200 (20) | $CF_3(CH_2)_2Si(OCH_3)_3$ (0.1) | $NH_2(CH_2)_2NH(CH_2)_3Si(OCH_3)_3$ (2.5) | $(CH_3)_3SiNHSi(CH_3)_3$ (2.5) |
| g | Aerosil 300 (50) | $CF_3(CH_2)_2Si(OCH_3)_3$ (0.1) | $NH_2(CH_2)_2NH(CH_2)_3Si(OCH_3)_3$ (7) | $(CH_3)_3SiNHSi(CH_3)_3$ (2) |
| h | Aerosil 130 (60) | $CF_3(CH_2)_2Si(OCH_3)_3$ (0.02) | $NH_2(CH_2)_2NH(CH_2)_3Si(OCH_3)_3$ (10) | $(CH_3)_3SiNHSi(CH_3)_3$ (2) |
| i | Aerosil 300 (30) | $CF_3(CF_2)_7(CH_2)_2Si(OCH_3)_3$ (4) | $NH_2(CH_2)_3Si(OCH_2CH_3)_3$ (0.1) | $(CH_3)_2Si(OCH_3)_2$ (2) |
| j | Aerosil 300 (40) | $CF_3(CH_2)_2Si(OCH_3)_3$ (0.01) | $NH_2(CH_2)_2NH(CH_2)_3Si(OCH_3)_3$ (7) | $(CH_3)_3SiNHSi(CH_3)_3$ (2) |
| k | Aerosil 130 (40) | $CF_3(CF_2)_5(CH_2)_2Si(OCH_3)_3$ (7) | — | — |
| l | Aerosil 200 (20) | — | $NH_2(CH_2)_2NH_2(CH_2)_3Si(OCH_3)_3$ (4) | $(CH_3)_3SiNHSi(CH_3)_3$ (3) |
| m | Aerosil 200 (50) | — | — | $(CH_3)_3SiCl_2$ (6) |
| n | Aerosil 200 | — | — | — |
| o | Aerosil 130 (35) | $CF_3(CF_2)_7(CH_2)_2Si(OCH_3)_3$ (4) | $NH_2(CH_2)_3Si(OCH_2CH_3)_3$ (0.15) | $(CH_3)_2Si(OCH_3)_2$ (2) |
| p | Aerosil 300 (20) | $CF_3(CF_2)_5(CH_2)_2Si(OCH_3)_3$ (1.4) | $NH_2(CH_2)_3Si(OCH_2CH_3)_3$ (0.1) | $(CH_3)_3SiNHSi(CH_3)_3$ (0.5) |
| q | Aerosil 200 (20) | $CF_3(CF_2)_5(CH_2)_2Si(OCH_3)_3$ (1.1) | $NH_2(CH_2)_3Si(OCH_2CH_3)_3$ (0.4) | $(CH_3)_3SiNHSi(CH_3)_3$ (0.5) |
| r | Aerosil 130 (60) | $CF_3(CH_2)_2Si(OCH_3)_3$ (0.04) | $NH_2(CH_2)_2NH(CH_2)_3Si(OCH_3)_3$ (10) | $(CH_3)_3SiNHSi(CH_3)_3$ (2) |

analytical value

TABLE 1-continued

| fine particle | hydrophobic degree (%) | charge amount by blow-off (μC/g) | fluorine atom (%) | nitrogen atom (%) |
|---|---|---|---|---|
| a | 58 | −705 | 3.142 | 0.0609 |
| b | 67 | −544 | 2.620 | 0.163 |
| c | 49 | −253 | 0.744 | 0.621 |
| d | 57 | −845 | 5.154 | 0.033 |
| e | 65 | +210 | 0.533 | 2.660 |
| f | 60 | +482 | 0.104 | 2.185 |
| g | 53 | +647 | 0.044 | 2.599 |
| h | 59 | +810 | 0.0072 | 3.048 |
| i | 61 | −871 | 6.302 | 0.030 |
| j | 59 | +896 | 0.004 | 2.523 |
| k | 40 | −733 | 9.235 | 0 |
| l | 63 | +906 | 0 | 2.436 |
| m | 37 | −776 | 0 | 0 |
| n | 0 | −885 | 0 | 0 |
| o | 60 | −793 | 5.52 | 0.040 |
| p | 52 | −754 | 3.36 | 0.050 |
| q | 52 | −504 | 2.64 | 0.198 |
| r | 59 | +790 | 0.014 | 3.045 |

EXAMPLE 1

(Preparation of Toner 1)

| ingredient | parts by weight |
|---|---|
| Styrene/n-butyl methacrylate/copolymer resin (number-average molecular weight Mn: 9300, weight-average molecular weight Mw: 2139000, Mw/Mn: 23, softening point: 130° C., glass transition point: 60° C.) | 100 |
| Carbon black MA#8 (made by Mitsubishi Kasei K.K.) | 5 |
| Off-set prevention agent Viscol 550p (made by Sanyo Kasei Kogyo K.K.) | 5 |

The above ingredients were mixed in Henschel Mixer and kneaded with the use of a twin-screw extruding kneader. After that, the kneaded mixture was cooled, then pulverized into coarse particles, and the coarse particles were further pulverized under jet stream followed by being air-classified to obtain a toner of 5–25 μm (11.3 μm in mean particle size)

Hydrophobic fine particle (a) of 0.15 parts by weight was admixed with the above obtained toner of 100 parts by weight at 1200 rpm in Henschel mixer for one minute. The resultant toner is referred to as Toner 1.

(preparation of carrier)

| ingredient | parts by weight |
|---|---|
| Polyester resin (softening point: 123° C., glass transition point: 65° C., AV: 23, OHV: 40) | 100 |
| Ferrite fine particle of Fe—Zn series MFP-2 (made by TDK K.K.) | 500 |
| carbon black (AM#8: made by Mitsubishi Kasei Kogyo) | 2 |

The above ingredients were mixed sufficiently in a Henshchel mixer, pulverized and fused and kneaded using an extrusion kneader wherein the temperature of cylinder and cylinder head was set to 180° C. and 170° C. respectively. The kneaded mixture was cooled, then pulverized in a jet mill, then classified using a classifier to obtain carrier of 60 μm in mean particle size.

(two component developer and evaluation thereof)

Toner 1 (64 g) was mixed with binder-type carrier of 800 g to prepare two-component developer. The resultant developer was subjected to measurement of charge amount, a practical copying test, an environmental test.

The developer of the invention was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

In Table 2, there are summarized charge amounts and bulking density of toners prepared in Examples 2–8 and Comparative Examples 1–8 as well as those of Example 1.

Bulking density was measured according to JIS K-5105. The higher the bulking density is, the higher the flow characteristics of toner are.

TABLE 2

| | Toner No. | bulking density (g/cc) | charge amount [μC/g] 3 min. | 10 min. | 30 min. | fine particle |
|---|---|---|---|---|---|---|
| Example 1 | 1 | 0.351 | −14.1 | −14.0 | −14.1 | a |
| Example 2 | 2 | 0.357 | −12.9 | −13.2 | −13.4 | b |
| Example 3 | 3 | 0.363 | −12.5 | −12.9 | −13.3 | c |
| Example 4 | 4 | 0.345 | −12.2 | −13.5 | −14.1 | d |
| Example 5 | 5 | 0.366 | +13.3 | +13.8 | +14.2 | e |
| Example 6 | 6 | 0.358 | +14.0 | +14.4 | +14.5 | f |
| Example 7 | 7 | 0.350 | +14.5 | +14.6 | +14.6 | g |
| Example 8 | 8 | 0.346 | +12.6 | +13.6 | +14.5 | h |
| Comparative Example | | | | | | |
| 1 | 9 | 0.330 | −7.8 | −10.1 | −13.5 | k |
| 2 | 10 | 0.332 | +9.9 | +12.6 | +14.0 | l |
| 3 | 11 | 0.339 | −7.2 | −9.6 | −12.9 | m |
| 4 | 12 | 0.314 | −5.0 | −6.3 | −4.7 | n |
| 5 | 13 | 0.329 | −7.9 | −10.4 | −13.3 | k + l |
| 6 | 14 | 0.327 | +10.0 | +12.0 | +13.8 | k + l |

EXAMPLE 2

| ingredient | parts by weight |
|---|---|
| Polyester resin NE-1110 (Kao K.K.) | 100 |
| Blue Pigment (Copper phthalocyanine) (Toyo Ink Seizo K.K.) | 8 |
| Off-set prevention agent Biscol TS 200 | 5 |

-continued

| ingredient | parts by weight |
|---|---|
| (Sanyo Kasei Kogyo K.K.) | |

The above ingredients were treated in a manner similar to Example 1 to obtain a toner of 5–25 μm (10.1 μm in mean particle size).

Hydrophobic Fine particle (b) of 0.4 parts by weight was admixed with the above obtained toner of 100 parts by weight at 1200 rpm in a Henschel mixer for one minute. The resultant toner is referred to as Toner 2.

A developer was prepared in a manner similar to Example 1 using the above obtained Toner 2.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity).

EXAMPLE 3

A toner was prepared in a manner similar to Example 1, except that Spilon black TRH (made by Hodoya Kagaku Kogyo K.K.) of 2 parts by weight was used as a charge controlling agent.

Hydrophobic Fine particle (c) of 0.3 parts by weight was admixed with the above obtained toner of 100 parts by weight at 1500 rpm in a Henschel mixer for one minute. The resultant toner is referred to as Toner 1.

A developer was prepared in a manner similar to Example 1 using the above obtained Toner 3.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

EXAMPLE 4

Toner 4 was prepared in a manner similar to Example 1 except that hydrophobic Fine particle (d) was used instead of hydrophobic Fine particle (a).

The resultant toner was estimated in a manner similar to Example 1 to obtain good copied images without fogs.

EXAMPLE 5

(Preparation of Toner 5)

| ingredient | parts by weight |
|---|---|
| Styrene/n-butyl methacrylate/copolymer resin (number-average molecular weight Mn: 9300, weight-average molecular weight Mw: 2139000, Mw/Mn: 23, softening point: 130° C., glass transition point: 60° C.) | 100 |
| Carbon black MA#8 (made by Mitsubishi Kasei K.K.) | 6 |
| Off-set prevention agent Viscol 550p (made by Sanyo Kasei Kogyo K.K.) | 5 |

-continued

| ingredient | parts by weight |
|---|---|
| charge controlling agent Bontron N-01 (made by Orient Kagaku Kogyo K.K.) | 5 |

The above ingredients were mixed in Henschel Mixer and kneaded with the use of a twin-screw extruding kneader. After that, the kneaded mixture was pulverized into coarse particles, and the coarse particles were further pulverized under jet stream followed by being air-classified to obtain a toner of 5–25 μm (11.3 μm in mean particle size)

Hydrophobic Fine particle (e) of 0.4 parts by weight was admixed with the above obtained toner of 100 parts by weight at 1100 rpm in Henschel mixer for one minute. The resultant toner is referred to as Toner 5.

Toner 5 was very excellent in flow characteristics and put into a copying machine EP470Z (made by Minolta Camera K.K.). The evaluation was carried out in a manner similar to Example 1 to obtain very good copied images without fogs.

EXAMPLE 6

(Preparation of Toner 6)

| ingredient | parts by weight |
|---|---|
| Styrent/n-butyl methacrylate/copolymer resin (number-average molecular weight Mn: 5400, weight-average molecular weight Mw: 243000, Mw/Mn: 45, softening point: 121° C., glass transition point: 59° C., acid value: 14) | 100 |
| Carbon black MA#8 (made by Mitsubishi Kasei K.K.) | 8 |
| Off-set prevention agent Viscol 550p (made by Sanyo Kasei Kogyo K.K.) | 5 |

The above ingredients were treated in a manner similar to Example 1 to obtain a toner of 2–25 μm (10.3 μm in mean particle size)

Hydrophobic Fine particle (f) of 0.2 parts by weight was admixed with the above obtained toner of 100 parts by weight at 1000 rpm in Henschel mixer for one minute. The resultant toner is referred to as Toner 6.

A developer was prepared using the above obtained Toner 6 and estimated in a manner similar to Example 5 to obtain very good copied images without fogs.

EXAMPLE 7

Toner 7 was prepared in a manner similar to Example 6 except that hydrophobic Fine particle (g) of 0.2 parts by weight was used on the basis of 100 parts by weight of the toner particle of Example 6.

The resultant Toner 7 was estimated in a manner similar to Example 6 to obtain good copied images without fogs.

EXAMPLE 8

Toner 8 was prepared in a manner similar to Example 6 except that hydrophobic Fine particle (h) was used instead of hydrophobic Fine particle (f).

The resultant Toner 8 was estimated in a manner similar to Example 5 to obtain good copied images without fogs.

COMPARATIVE EXAMPLE 1

Toner 9 was prepard in a manner similar to Example 1, except that hydrophobic Fine particle (k) was used instead of hydrophobic Fine particle (a).

A developer was prepared using Toner 9 and estimated in a manner similar to Example 1. In durability test with respect to copy, both flow characteristics and electrification build-up properties were poor. Fogs were observed on copying paper after 50000 times of copy.

COMPARATIVE EXAMPLE 2

Toner 10 was prepared in a manner similar to Example 6, except that hydrophobic Fine particle (l) was used instead of hydrophobic Fine particle (f).

A developer was prepared using Toner 10 and estimated in a manner similar to Example 5. I durability test with respect to copy, both flow characteristics and electrification build-up properties were poor. Fogs were observed on copying paper after 50000 times of copy.

COMPARATIVE EXAMPLE 3

Toner 11 was prepared in a manner similar to Example 1, except that hydrophobic Fine particle (m) was used instead of hydrophobic Fine particle (a).

A developer was prepared using Toner 11 and estimated in a manner similar to Example 1. In durability test with respect to copy, both flow characteristics and electrification build-up properties were poor. Fogs were observed on copying paper after 50000 times of copy.

COMPARATIVE EXAMPLE 4

Toner 12 was prepared in a manner similar to Example 1, except that hydrophobic Fine particle (n) was used instead of hydrophobic Fine particle (a).

A developer was prepared using Toner 12 and estimated in a manner similar to Example 1. In durability test with respect to copy, both flow characteristics and electrification build-up properties were poor. Fogs were observed on copying paper at the initial stage of the durability test.

COMPARATIVE EXAMPLE 5

Toner 13 was prepared in a manner similar to Example 1, except that hydrophobic Fine particle (k) of 0.12 parts by weight and hydrophobic Fine particle (l) of 0.03 parts by weight were used instead of hydrophobic Fine particle (a) of 0.15 parts by weight.

A developer was prepared using Toner 13 and estimated in a manner similar to Example 1. In durability test with respect to copy, both flow characteristics and electrification build-up properties were poor. Much toner flying and fogs were observed at the initial stage of the durability test.

COMPARATIVE EXAMPLE 6

Toner 14 was prepared in a manner similar to Example 6, except that hydrophobic Fine particle (k) of 0.02 parts by weight and hydrophobic Fine particle (l) of 0.18 parts by weight were used instead of hydrophobic fine particle (f) of 0.2 parts by weight.

A developer was prepared using Toner 14 and estimated in a manner similar to Example 6. In durability test with respect to copy, both flow characteristics and electrification build-up properties were poor. Much toner flying and fogs were observed at the initial stage of the durability test.

EXAMPLE 9

(Preparation of Toner 15)

| ingredient | parts by weight |
|---|---|
| Styrene/n-butyl methacrylate/copolymer resin (number-average molecular weight $\overline{M}n$: 9300, weight-average molecular weight $\overline{M}w$: 2139000, $\overline{M}w/\overline{M}n$: 23, softening point: 130° C., glass transition point: 60° C.) | 100 |
| Carbon black MA#8 (made by Mitsubishi Kasei K.K.) | 5 |
| Fine particle (a) | 2 |
| Off-set prevention agent Viscol 550p (made by Sanyo Kasei Kogyo K.K.) | 5 |

The above ingredients were mixed in Henschel Mixer and kneaded with the use of a twin-screw extruding kneader. After that, the kneaded mixture was cooled, then pulverized into coarse particles, and the coarse particles were further pulverized under jet stream followed by being air-classified to obtain a toner of 5–25 μm (11.3 μm in mean particle size). The resultant toner is referred to as Toner 15.

A developer was prepared in a manner similar to Example 1 using the above obtained Toner 15.

The resultant toner was subjected to measurement of charge amount (electrification build up properties), a practical copying test and an environmental test.

The electrification build up properties were measured as below;

Post-treated Toner 15 (wherein Toner 15 of 100 parts by weight was mixed with colloidal Silica R-972 (made by Nippon Aerosil K.K.)) of 2 g and carrier of 28 g were put into a polymer bottle with capacity of 50 cc.

Charge amounts were measured after the bottle was rotated at 1200 rpm for 3 minutes, 10 minutes and 30 minutes respectively.

The results of electrification build up characteristics were summarized in Table 3, including those of Examples 10–15 and Comparative Examples 7–12.

The above obtained developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity).

TABLE 3

| | Toner No. | fine particle No. | charge amount [μC/g] 3 min. | 10 min. | 30 min. |
|---|---|---|---|---|---|
| Example 9 | 15 | a | −14.5 | −14.4 | −14.5 |
| Example 10 | 16 | a | −15.0 | −15.2 | −15.2 |
| Example 11 | 17 | b | −14.1 | −14.1 | −14.2 |
| Example 12 | 18 | d | −14.9 | −14.7 | −15.0 |
| Example 13 | 19 | f | +13.3 | +13.6 | +13.6 |
| Comparative Example | | | | | |
| 7 | 20 | k | −10.7 | −12.4 | −14.9 |
| 8 | 21 | l | +9.9 | +12.7 | +14.9 |
| 9 | 22 | m | −8.5 | −10.1 | −13.3 |
| 10 | 23 | n | −5.0 | −6.2 | −4.8 |
| Example | | | | | |

TABLE 3-continued

| | Toner No. | fine particle No. | charge amount [μC/g] 3 min. | 10 min. | 30 min. |
|---|---|---|---|---|---|
| 14 | 24 | g | +14.0 | +14.4 | +14.5 |
| 15 | 25 | h | +15.1 | +15.3 | +15.3 |
| Comparative Example | | | | | |
| 11 | 26 | k + 1 | −10.3 | −12.0 | −14.6 |
| 12 | 27 | k + 1 | +10.0 | +11.9 | +14.4 |

EXAMPLE 10

(Preparation of Toner 16)

| ingredient | parts by weight |
|---|---|
| Styrene/n-butyl methacrylate/copolymer resin (number-average molecular weight Mn: 5400, weight-average molecular weight Mw: 243000, Mw/Mn: 45, softening point: 121° C., glass transition point: 59° C., acid value: 14) | 100 |
| Carbon black MA#8 (made by Mitsubishi Kasei K.K.) | 8 |
| Off-set prevention agent Viscol 550p (made by Sanyo Kasei Kogyo K.K.) | 5 |

The above ingredients were mixed in a manner similar to Example 9 to obtain a toner of 5–25 μm (10.1 μm in mean particle size).

Hydrophobic Fine particle (a) of 1 part by weight was treated with the above obtained toner of 100 parts by weight at 9000 rpm for 3 minutes in Hybridizer (Hybridization system NHS-1 type (made by Nara Kikai Seisakusyo K.K.)). Thus, the fine particle was fixed on the surface of the toner particle. The resultant toner is referred to as Toner 16.

A developer was prepared and evaluated in a manner similar to Example 9 using the above obtained Toner 16.

The resultant developer was put into an electrophotographic copying machine EP-870 (made by Minolta Camera K.K.) to be tested o durability with respect to copy.

Even after about 100000 sheets of paper was subjected to practical copying process, clear images without fogs were formed. Further, with respect to an environmental test, good images without fogs were formed even under high temperature and high humidity (35° C. of temperature, 85% of humidity)

EXAMPLE 11

Polyester resin (NE-1110; made by Kao K.K.) of 100 parts by weight, a blue pigment (Copper phthalocyanine; made by Toyo Ink Seizo K.K.) of 8 parts by weight, an off-set prevention agent (biscol TS 200; made by Sanyo Kasei Kogyo K.K.) of 5 parts by weight and Fine particle (b) of 3 parts by weight were treated in a manner similar to Example 9 to obtain Toner 17 of 5–25 μm (10.1 μm in mean particle size).

A developer was prepared and evaluate in a manner similar to Example 9 using the above obtained Toner 17.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

EXAMPLE 12

Toner 18 was prepared in a manner similar to Example 9 except that hydrophobic Fine particle (d) of 2 parts by weight was added instead of Fine particle (a). The obtained Toner 18 was 11.3 μm in mean particle size.

A developer was prepared and evaluated in a manner similar to Example 9 using the above obtained Toner 18.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

EXAMPLE 13

Toner 19 was prepared in a manner similar to Example 9 except that hydrophobic Fine particle (f) of 1 part by weight was added instead of Fine particle (a). The obtained Toner 19 was 11.5 μm in mean particle size.

A developer was prepared and evaluated in a manner similar to Example 9 using the above obtained Toner 19.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

EXAMPLE 14

Toner 24 was prepared in a manner similar to Example 9 except that hydrophobic Fine particle (g) of 3 parts by weight was added instead of Fine particle (a). The obtained Toner 24 was 11.1 μm in mean particle size.

A developer was prepared and evaluated in a manner similar to Example 9 using the above obtained Toner 24.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

EXAMPLE 15

Toner 25 was prepared in a manner similar to Example 9 except that hydrophobic Fine particle (h) of 3 parts by weight was added instead of Fine particle (a). The obtained Toner 25 was 11.2 μm in mean particle size.

A developer was prepared and evaluated in a manner similar to Example 9 using the above obtained Toner 25.

The resultant developer was put into an electrophotographic copying machine EP-870 (made by Minolta Camera K.K.) to be tested on durability with respect to copy.

Even after about 100000 sheets of paper was subjected to practical copying processes, clear images without fogs were formed. Further, with respect to an environmental test, good images without fogs were formed even under high temperature and high humidity (35° C. of temperature, 85% of humidity)

COMPARATIVE EXAMPLE 7

Toner 20 was prepared in a manner similar to Example 13 except that Fine particle (k) was added instead of Fine particle (a).

A developer was prepared using Toner 20 and evaluated in a manner similar to Example 9.

Electrification build-up characteristics were poor and in durability test with respect to copy, fogs were observed after 20000 times of copy.

COMPARATIVE EXAMPLE 8

Toner 21 was prepared in a manner similar to Example 13 except that Fine particle (l) was added instead of Fine particle (f).

A developer was prepared using Toner 21 and evaluated in a manner similar to Example 13.

Electrification build-up characteristics were poor and in durability test with respect to copy, fogs were observed after 20000 times of copy.

COMPARATIVE EXAMPLE 9

Toner 22 was prepared in a manner similar to Example 9 except that Fine particle (m) was added instead of Fine particle (a).

A developer was prepared using Toner 22 and evaluated in a manner similar to Example 9.

Electrification build-up characteristics were poor, and in durability test with respect to copy, fogs were observed after 30000 times of copy.

COMPARATIVE EXAMPLE 10

Toner 23 was prepared in a manner similar to Example 13 except that Fine particle (n) was added instead of Fine particle (a).

A developer was prepared using Toner 23 and evaluated in a manner similar to Example 9.

In durability test with respect to copy, much toner flying and fogs were observed at the initial stage of the durability test.

COMPARATIVE EXAMPLE 11

Toner 26 was prepared in a manner similar to Example 9 except that Fine particle (k) of 1.6 parts by weight and Fine particle (l) of 0.4 parts by weight was added instead of Fine particle (a) of 1 part by weight.

A developer was prepared using Toner 26 and evaluated in a manner similar to Example 9.

In durability test with respect to copy, much toner flying and fogs were observed at the initial stage of the durability test.

COMPARATIVE EXAMPLE 12

Toner 27 was prepared in a manner similar to Example 13 except that Fine particle (k) of 0.1 part by weight and fine particle (l) of 0.9 parts by weight was added instead of Fine particle (f) of 1 part by weight.

A developer was prepared using Toner 27 and evaluated in a manner similar to Example 9.

In durability test with respect to copy, much toner flying and fogs were observed at the initial stage of the durability test.

EXAMPLE 16

| ingredient | parts by weight |
|---|---|
| Bisphenol A type polyester resin (AV: 19, OHV: 23, softening point: 123° C., Tg: 65° C.) | 100 |
| Carbon black MA#8 (made by Mitsubishi Kasei Kogyo K.K.) | 5 |
| Spilon Black TRH (made by Hodoya Kagaku K.K.) | 1 |
| Viscol TS-200 (made by Sanyo Kasei K.K.) | 2.5 |

The above ingredients were kneaded, ground, classified by a known method to obtain toner particles of 10 μm in mean particle size. The eighty percents of the toner particles were distributed within the range of between 7 μm and 13 μm.

Fine particle (o) was added to the above obtained toner at the content of 0.75 percents by weight. The mixture was stirred at 2000 rpm for 1 minute in Homogenizer to obtain Toner 28.

Figure 3:
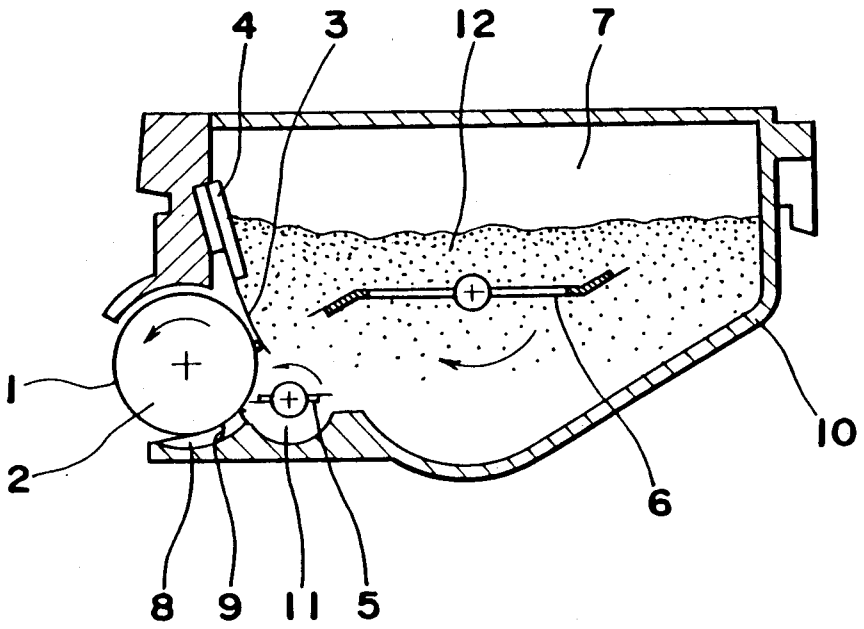
FIG. 3 shows schematically a developing machine for non-magnetic single component.

Then thus obtained Toner 28 was put into a developing machine for non-magnetic single component, shown in FIG. 3 schematically. The developing machine was installed in a printer for electrophotography (35 mm/sec in system speed).

Toner (12) is accommodated in a hopper part (7) formed by a casing, and brought to a toner-providing part (11) by a stirring member (6) rotating in the direction of the arrow shown in the Figure. The toner brought into the toner-providing part (11) is provided onto the surface of a developing sleeve (1) by a rotating toner providing member (5) having two fins.

The developing sleeve (1) is a cylindrical thin member with 20 mm in inner diameter and 35 μm in thickness, which is made of Nickel film and treated by electrofoaming method. The outer surface of the sleeve is made rough so that the surface roughness $R_2$ may be about 2 μm. The developing sleeve (1) is mounted around a driving roller (2), supported by a guide member (not shown) so that the developing sleeve (1) may rotate along the driving roller and the space may be formed between the driving roller (2) and the developing sleeve, and driven in compliance with the movement of rotation of driving roller.

The toner provided onto the surface of developing sleeve is formed into a thin layer of 20–30 μm in thickness and charged by a toner leveling member which is expressed against the surface of the developing sleeve at the pressure of about 5 g/mm$^2$. Then, the thin layer of charged toner is transferred along with the movement of the developing sleeve at the driving speed of 105 mm/sec in circumferential speed to the position confronting a photosensitive drum (not shown) on the surface of which electrostatic latent images are formed. The thin layer of charged toner contacts softly with the surface of photosensitive drum. The charged toner is attracted by the electrostatic latent images to make them visible.

As a result, clear copied images of high quality were formed, in which the toner dirt on the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed. Further, after used for a long time, copied images of high quality were formed constantly and that clearness of copied images was not lost.

Even when the copying machine was derived using Toner 28 of the present invention under high humidity and high temperature for environmental test, copied images of high quality without fogs on the ground were formed.

Figure 2:
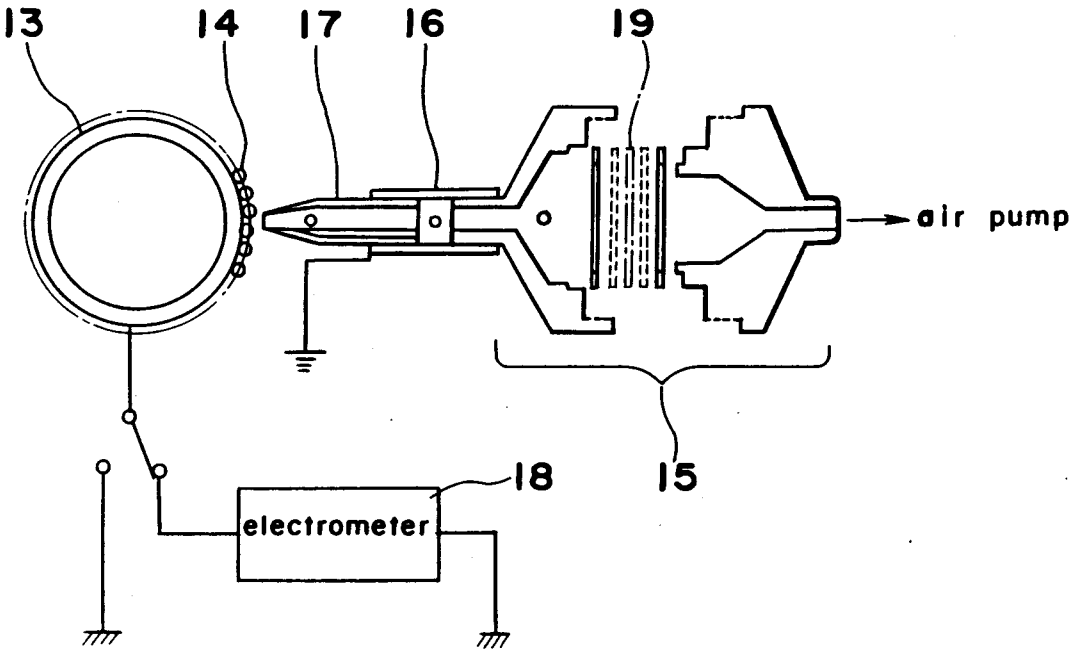
FIG. 2 shows schematically a measuring machine for a toner charge amount.

A charge amount of toner with respect to a thin layer of charged toner was measured as below (FIG. 2). A developing machine shown in FIG. 3 was applied to the measurement.

A developing sleeve (13) (which corresponds to (1) in FIG. (3)) is connected to an electrometer (18). A filter holder (15) is equipped with a membrane filter (19) (pore size $\phi = 1$ μm), the one end of the filter holder is provided with a suction mouth of a glass tube (17) through a rubber tube (16). The other end is connected to an air pump (not shown) through a vacuum hose of rubber (not shown).

The air pump is worked to absorb toner (14) on the surface of the developing sleeve (13), and the charge amount (−Q) opposite to that of the absorbed toner is measured by the electrometer (18). The weight of the absorbed toner (M) is measured to calculate the value of Q/M. The value Q/M is a charge amount of toner. In the measurement above, the developing sleeve is rotated at the circumferential speed of 105 mm/sec.

Further, in order to obtain the dependence of a charge amount of toner on the revolution member of developing sleeve, toner of the thin layer formed on the developing sleeve after specified number of revolution is absorbed to measure the charge amount.

Figure 4:
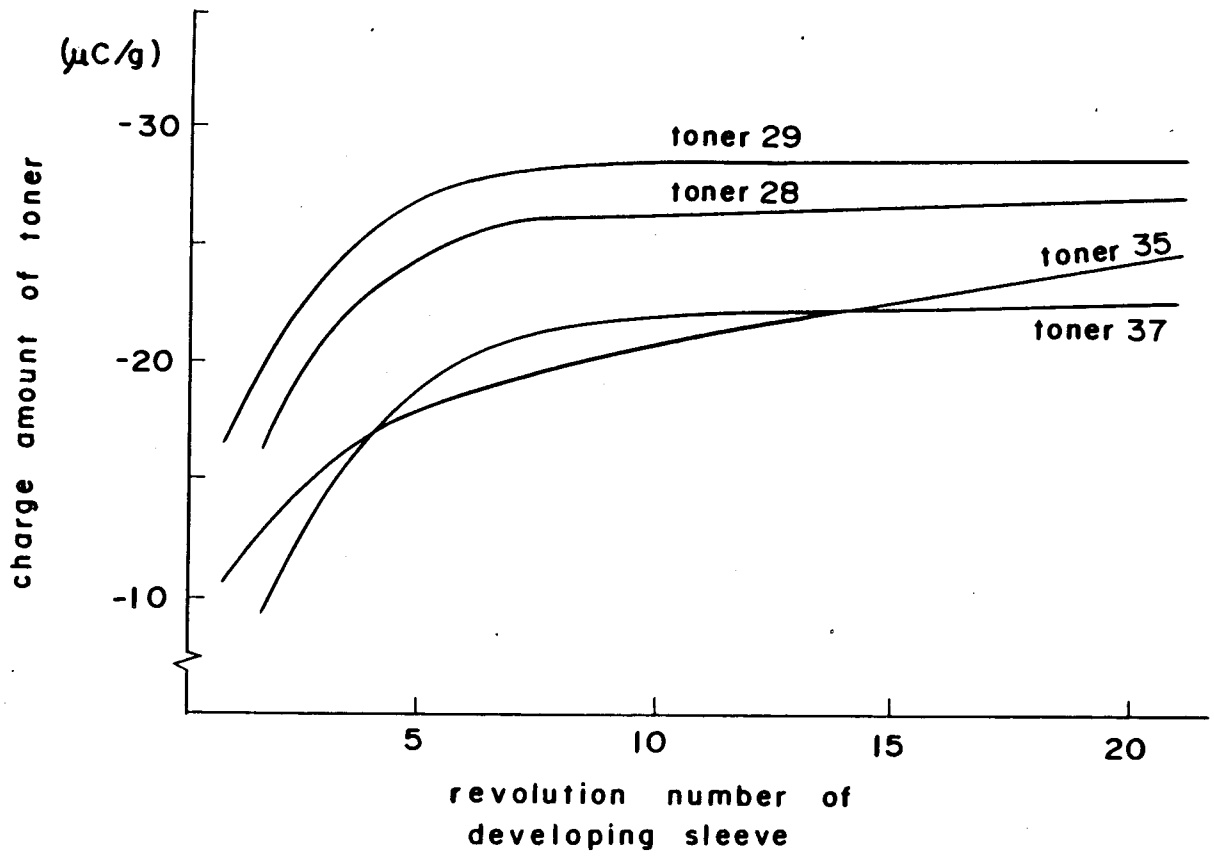
FIG. 4 shows the relationship between the charge amount of toner and the revolution number of the developing sleeve.

FIG. 4 shows the relationship between the charge amount of toner and the revolution number of the developing sleeve as measured above.

It is understood from FIG. 4 that toners of the present invention are good in electrification build up properties and high in charged level.

In Table 4, the results of charge amounts and evaluation of images obtained in Examples 16–22 and Comparative Examples 13–18 as well as those of Example 1 are summarized.

The symbols in the column of fogs caused by memory effect mean that;

o: no fogs caused by memory effect were observed;

Δ: fogs caused by memory effect were not observed with the naked eye but they were observed by a test glass;

x: fogs caused by memory effect were observed

The symbols in the column of white spots caused by memory effects mean that;

o: no white spots were observed;

Δ: white spots were not observed with the naked eye, but the changes of the density of copied images were sometimes observed by a densitometer of copied images x: white spots were observed

TABLE 4

| | | | charge amount of toner (μc/g) | | copied images | |
|---|---|---|---|---|---|---|
| | Toner | fine particle | two revolutions of developing sleeve | twenty revolutions of developing sleeve | fogs caused by memory effect | white spots caused by memory effect |
| Example 16 | 28 | o | −18.0 | −26.9 | Δ | O |
| Example 17 | 29 | p | −21.0 | −27.4 | O | O |
| Example 18 | 30 | q | −21.5 | −26.3 | O | O |
| Example 19 | 31 | f | +21.0 | +25.9 | O | O |
| Example 20 | 32 | g | +21.7 | +28.0 | O | O |
| Example 21 | 33 | r | +19.1 | +24.5 | Δ | O |
| Example 22 | 34 | h | +18.2 | +24.4 | Δ | O |
| Comparative Example | | | | | | |
| 13 | 35 | k | −13.5 | −24.2 | X | Δ |
| 14 | 36 | l | +15.1 | +25.6 | X | Δ |
| 15 | 37 | m | −11.0 | −22.5 | X | X |
| 16 | 38 | n | −9.3 | −16.3 | X | X |
| 17 | 39 | k + l | −14.2 | −24.7 | X | X |
| 18 | 40 | K + l | −15.6 | +25.3 | X | X |

EXAMPLE 17

Toner 29 was prepared in a manner similar to Example 16 except that Fine particle (o) was used instead of Fine particle (p).

The obtained toner was put into the same developing machine for non-magnetic single component in Example 16. The developing machine was installed in a printer for electrophotography to evaluate the toner in a manner similar to Example 16.

As a result, clear copied images of high quality were formed, in which the toner dirt on the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed.

Even when the copying machine was drived using Toner 29 of the present invention under high humidity and high temperature for environmental test, copied images of high quality without fogs on the ground were formed.

It is understood from FIG. 4 that the toner of the present invention is good in electrification build-up properties and high in charge level.

EXAMPLE 18

Toner 30 was prepared in a manner similar to Example 16 except that Fine particle (o) was used instead of Fine particle (q).

The obtained toner was put into the same developing machine for non-magnetic single component in Example 16. The developing machine was installed in a printer for electrophotography to evaluate the toner in a manner similar to Example 16.

As a result, clear copied images of high quality were formed, in which the toner dirt of the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed.

A charge amount of the toner 30 was measured by a blow-off method in a similar manner to that of Example 14. The toner 30 was good in electrification build up properties and high in charge level.

EXAMPLE 19

| ingredient | parts by weight |
|---|---|
| Bisphenol A type polyester resin (AV: 1.3, softening point: 130° C., Tg: 62° C.) | 100 |
| Carbon black (Printex 35 made by Degussa K.K.) | 5 |
| Nigrosine base EX (made by Orient Kagaku Kogyo K.K.) | 3 |
| Viscol 550p (made by Sanyo Kasei Kogyo K.K.) | 2.5 |

The above ingredients were kneaded, ground, classified by a known method to obtain toner particles of 10.1 μm in mean particle size. The eighty percents of the toner particles were distributed within the range of between 7 μm and 13 μm.

Fine particle (f) was added to the above obtained toner at the content of 0.9 percents by weight. The mixture was stirred at 1000 rpm for 1 minute in Henschel mixer.

Thus obtained Toner 31 was put into a developing machine for non-magnetic single component, shown in FIG. 3. The developing machine was installed in a printer for electrophotography (35 mm/sec in system speed).

As a result, clear copied images of high quality were formed, in which the toner dirt of the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed. Further, after used for a long time, copied images of high quality were formed constantly and that clearness of copied images was not lost.

EXAMPLE 20

Toner 32 was prepared in a manner similar to Example 19 except that Fine particle (g) was used instead of Fine particle (f).

The obtained toner was put into the same developing machine for non-magnetic single component in Example 19. The developing machine was installed in a printer for electrophotography to evaluate the toner in a manner similar to Example 19.

As a result, clear copied images of high quality were formed, in which the toner dirt of the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed.

Even when the copying machine was drived using Toner 32 of the present invention under high humidity and high temperature for environmental test, copied images of high quality without fogs on the ground were formed.

EXAMPLE 21

Toner 33 was prepared in a manner similar to Example 19 except that Fine particle (r) was used instead of Fine particle (f).

The obtained toner was put into the same developing machine for non-magnetic single component in Example 19. The developing machine was installed in a printer for electrophotography to evaluate the toner in a manner similar to Example 19.

As a result, clear copied images of high quality were formed, in which the toner dirt of the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed.

Even when the copying machine was drived using Toner 33 of the present invention under high humidity and high temperature for environmental test, copied images of high quality without fogs on the ground were formed.

EXAMPLE 22

Toner 34 was prepared in a manner similar to Example 19 except that Fine particle (h) was used instead of Fine particle (f).

The obtained toner was put into the same developing machine for non-magnetic single component in Example 19. The developing machine was installed in a printer for electrophotography to evaluate the toner in a manner similar to Example 19.

As a result, clear copied images of high quality were formed, in which the toner dirt on the paper ground or around the copied characters caused by toner flying, or the disorder of edges of copied images was not observed. Even when solids images were copied, fogs caused by memory effect and white spots were not seen. The dirt of copied images and the dirt of the inside of the copying machine, which are generally caused by toner flying, were not observed.

Even when the copying machine was drived using Toner 34 of the present invention under high humidity and high temperature for environmental test, copied images of high quality without fogs on the ground were formed.

COMPARATIVE EXAMPLE 13

Toner 35 was prepared in a manner similar to Example 16 except that Fine particle (k) was used instead of Fine particle (o). The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

A charge amount of the toner 35 was measured in a manner similar to that of Example 16. The toner 35 was poor in electrification build up properties and a little low in charge level as shown in FIG. 4.

COMPARATIVE EXAMPLE 14

Toner 36 was prepared in a manner similar to Example 19 except that Fine particle (k) was used instead of Fine particle (f). The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

COMPARATIVE EXAMPLE 15

Toner 37 was prepared in a manner similar to Example 16 except that Fine particle (m) was used instead of Fine particle (o). The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

A charge amount of the toner 37 was measured in a manner similar to that of Example 16. The toner 37 was poor in electrification build up properties and a little low in charge level as shown in FIG. 4.

COMPARATIVE EXAMPLE 16

Toner 38 was prepared in a manner similar to Example 16 except that Fine particle (n) was used instead of Fine particle (o). The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

COMPARATIVE EXAMPLE 17

Toner 39 was prepared in a manner similar to Example 16 except that Fine particle (k) of 0.6 percents by weight and Fine particle (l) of 0.15 percents by weight were used instead of Fine particle (o) of 0.75 percents by weight. The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

COMPARATIVE EXAMPLE 18

Toner 40 was prepared in a manner similar to Example 19 except that Fine particle (k) of 0.1 percents by weight and Fine particle (l) of 0.8 percents by weight were used instead of Fine particle (f) of 0.9 percents by weight. The obtained toner was put into the same developing machine for non-magnetic single component in Example 16.

As a result, when solid images were copied, fogs caused by memory effect and white spots were observed at the constant interval which corresponded to the peripheral length of the developing sleeve. Copied images were of low quality and lacking in clearness because fogs on the copy ground, the dirt around the copied characters caused by toner flying and the disorder of edges of copied images were observed.

What is claimed is:

1. A developer for developer electrostatic latent images formed on an electrostatic latent image carrier, which comprises a toner comprising;

a resin, a colorant, and inorganic fine particles having both a negatively chargeable polar group and a positively chargeable polar group on the surface of the inorganic fine particles, said negatively chargeable polar group containing fluorine atoms at a content of from 0.005 to 6% and said positively chargeable polar group containing nitrogen atoms at a constant of from 0.04 to 5%, said contents being selected within said ranges to provide the inorganic fine particles with either a positive or negative charge.

2. A developer of claim 1, wherein the inorganic fine particles are surface-treated with at least a fluorine-coupling agent and an amine-coupling agent.

3. A developer of claim 1, wherein the inorganic fine particles are from 1 mμm to 2 μm in mean particle size.

4. A developer of claim 1, wherein the inorganic fine particles are from 30 to 80% in hydrophobic degree.

5. A developer of claim 1, which is a two components-system further comprising a carrier.

6. A developer of claim 1, wherein the toner is the one for non-magnetic single-component.

7. A developer for developing positive electrostatic latent images formed on an electrostatic latent image carrier, which comprises a negatively chargeable toner comprising;

a resin, a colorant, and inorganic fine particles which contain fluorine atoms at a content of from 2 to 6% and nitrogen atoms at a content of from 0.04 to 0.2% on the surface of the inorganic fine particles.

8. A developer for developing negative electrostatic latent images formed on an electrostatic latent image carrier, which comprises a positively chargeable toner comprising;

a resin, a colorant, and inorganic fine particles which contain fluorine atoms at a content of from 0.005 to 0.2% and nitrogen atoms at a content of from 2 to 5% on the surface of the inorganic fine particles.

9. A developer for developing electrostatic latent images formed on an electrostatic latent image carrier, which is formed by mixing a toner comprising at least a resin and a colorant with inorganic fine particles having both a negatively chargeable polar group and a positively chargeable polar group on the surface of the inorganic fine particles, said negatively chargeable polar group containing fluorine atoms at a constant of from 0.005 to 6% and said positively chargeable polar group containing nitrogen atoms at a content of from 0.04 to 5%, said contents being selected within said ranges to provide the inorganic fine particles with either a positive or negative charge.

10. A developer of claim 9, wherein the inorganic fine particles are surface-treated with at least a fluorine-coupling agent and an amine-coupling agent.

11. A developer of claim 9, wherein the inorganic fine particles are from 1 mμm to 2 μm in mean particle size.

12. A developer of claim 9, wherein the inorganic fine particles are 30 to 80% in hydrophobic degree.

13. A developer of claim 11, wherein the content of fluorine in the inorganic fine particles is from 0.005 to 6% the content of nitrogen is from 0.04 to 5%.

14. A developer of claim 9, which is a two components-system further comprising a carrier.

15. A developer of claim 9, wherein the toner is the one for non-magnetic single-component.

16. A developer for developing positive electrostatic latent formed on an electrostatic latent image carrier, which is formed by mixing a negatively chargeable toner comprising at least a resin and a colorant with inorganic fine particles which contain fluorine atoms at a content of from 2 to 6% and nitrogen atoms at a content of from 0.04 to 0.2% on the surface of the inorganic fine particles.

17. A developer for developing negative electrostatic latent images formed on an electrostatic latent image carrier, which is formed by mixing a positively chargeable toner comprising at least a resin and a colorant with inorganic fine particles which contain fluorine atoms at a content of from 0.005 to 0.2% and nitrogen atoms at a content of from 2 to 5% on the surface of the inorganic fine particles.

18. A developer of claim 14, wherein said inorganic particles are mixed at a content of from 0.05 to 5% by weight on the basis of toner.

19. A developer of claim 15, wherein said inorganic particles are mixed at a content of from 0.1 to 3% by weight on the basis of toner.

20. A developer composition comprising inorganic fine particles having at least both a negatively chargeable polar group and a positively chargeable polar group on the surface of the inorganic fine particles, said negatively chargeable polar group containing fluorine atoms at a constant of from 0.005 to 6% and said positively chargeable polar group containing nitrogen atoms at a content of from 0.04 to 5%, said contents being selected within said ranges to provide the inorganic fine particles with either a positive or negative charge.

21. A developer composition of claim 20, wherein said inorganic particles are surface-treated with a hydrophobic agent.

22. A developer composition of claim 21, wherein said hydrophobic agent is a silane coupling agent, titanate coupling agent, aluminum coupling agent or zircoaluminate coupling agent.

23. A process for preparing a developer composition comprising the steps of providing inorganic fine particles selected from the group consisting of silicon dioxide, silicate, titanium dioxide, alumina, magnesium carbonate, barium titanate and zinc oxide, said inorganic fine particles being from 1 mμm to 2 μm in mean particle size, preparing a mixed solution which includes a fluorine-containing coupling agent, a nitrogen-containing coupling agent and an organic solvent, and dipping said inorganic fine particles in said mixed solution.

* * * * *